United States Patent [19]

Caswell et al.

[11] Patent Number: 4,857,213

[45] Date of Patent: Aug. 15, 1989

[54] LIQUID DETERGENT CONTAINING CONDITIONING AGENT AND HIGH LEVELS OF ALKYL SULFATE/ALKYL ETHOXYLATED SULFATE

[75] Inventors: Debra S. Caswell, Cincinnati, Ohio;

[73] Assignee: The Procter & Gamble Company, Cincinnati, Ohio

[21] Appl. No.: 153,173

[22] Filed: Feb. 8, 1988

[51] Int. Cl.[4] ..... D06M 13/36; C11D 1/65; C11D 3/43; C11D 17/08

[52] U.S. Cl. ..... 252/8.75; 252/8.8; 252/170; 252/171; 252/173; 252/525; 252/526; 252/528; 252/531; 252/532; 252/544; 252/545; 252/547; 252/550; 252/551; 252/DIG. 14

[58] Field of Search ..... 252/8.8, 525, 528, 545, 252/547, DIG. 14, 8.75, 526, 544, 173, 170, 171; 427/242

[56] References Cited

U.S. PATENT DOCUMENTS

| | | | |
|---|---|---|---|
| 2,691,636 | 10/1954 | Stayner et al. | 252/152 |
| 3,696,056 | 10/1972 | Inamorato | 252/525 |
| 3,904,533 | 9/1975 | Neiditch et al. | 252/8.8 |
| 3,936,537 | 2/1976 | Baskerville et al. | 427/242 |
| 3,959,155 | 5/1976 | Montgomery | 252/8.8 |
| 4,058,489 | 11/1977 | Hellsten | 252/8.75 |
| 4,108,600 | 8/1978 | Wong | 8/137 |
| 4,173,539 | 11/1979 | Rule et al. | 252/8.8 |
| 4,292,035 | 9/1981 | Battrell | 8/137 |
| 4,294,710 | 10/1981 | Hardy et al. | 252/8.8 |
| 4,303,543 | 12/1981 | Mansy | 252/117 |
| 4,375,416 | 3/1983 | Crisp et al. | 252/8.7 |
| 4,514,444 | 4/1985 | Ives et al. | 427/242 |
| 4,661,269 | 4/1987 | Trinh et al. | 252/8.8 |

FOREIGN PATENT DOCUMENTS

| | | |
|---|---|---|
| 818419 | 7/1969 | Canada . |
| 1186458 | 5/1985 | Canada . |
| 133804 | 6/1985 | European Pat. Off. . |
| 1077103 | 7/1967 | United Kingdom . |
| 1077104 | 7/1967 | United Kingdom . |
| 1230792 | 5/1971 | United Kingdom . |
| 1514276 | 6/1978 | United Kingdom . |

*Primary Examiner*—Dennis Albrecht
*Assistant Examiner*—Kathlene Markowski
*Attorney, Agent, or Firm*—Leonard W. Lewis; Steven J. Goldstein; Jerry J. Yetter

[57] ABSTRACT

Disclosed are liquid detergent compositions containing from about 5% to about 40% of an alkyl sulfate or alkyl ethoxylated sulfate surfactant, or mixture thereof, and water-insoluble, amine-organic anion ion-pair conditioning particles in a liquid base. The alkyl sulfate, alkyl ethoxylated sulfate, or mixture thereof, stabilizes the conditioning particles for improved shelf-life.

17 Claims, No Drawings

LIQUID DETERGENT CONTAINING CONDITIONING AGENT AND HIGH LEVELS OF ALKYL SULFATE/ALKYL ETHOXYLATED SULFATE

TECHNICAL FIELD

This invention relates to liquid detergent compositions containing an alkyl sulfate/alkyl ethoxylated sulfate surfactant component, or mixtures thereof, and an amine-organic anion ion-pair complex conditioning agent.

BACKGROUND OF THE INVENTION

Numerous attempts have been made to formulate laundry detergent compositions which provide the good cleaning performance expected of them and which also have good through-the-wash fabric conditioning benefits, such as softening and antistatic properties. Attempts have been made to incorporate cationic conditioners in anionic surfactant-based built detergent compositions employing various means of overcoming the natural antagonism between the anionic and cationic surfactants. For instance, U.S. Pat. No. 3,936,537, Baskerville et al., issued Feb. 3, 1976, discloses detergent compositions comprising organic surfactant, builders, and, in particulate form (10 to 500 microns), a quaternary ammonium softener combined with a poorly water-soluble dispersion inhibitor which inhibits premature dispersion of the cationic in the wash liquor. Even in these compositions some compromise between cleaning and softening effectiveness has to be accepted. Another approach to provide detergent compositions with softening ability has been to employ nonionic surfactants (instead of anionic surfactants) with cationic softeners. Compositions of this type have been described in, for example, German Pat. No. 1,220,956, assigned to Henkel, issued Apr. 4, 1964; and in U.S. Pat. No. 3,607,763, Salmen et al., issued Sept. 21, 1971. However, the detergency benefits of nonionic surfactants are inferior to those of anionic surfactants, especially relative to alkyl sulfates and alkyl ethoxylated sulfates, which provide excellent cleaning performance in liquid detergent compositions.

In European Patent Application No. 87202159.7, filed Nov. 6, 1987, amine-anionic compound ion-pair complex particles having an average particle diameter of from about 10 microns to about 300 microns were disclosed. These particles provide excellent through-the-wash conditioning without significantly impairing cleaning performance. European Patent Application No. 87202159.7 further discloses that ion-pair particles which are made from lower alkyl chain length linear alkyl benzene sulfonates impart improved processing characteristics and also improved chemical stability in liquid detergents to provide longer shelf-life to the conditioning agent particles. Even further improvements in the processing characteristics and chemical stability of amine-organic anion ion-pair complex particles are obtained by incorporating certain levels of amine-inorganic ion-pair complexes into the particles as disclosed in U.S. patent application Ser. No. 153,172, "Conditioning Agent Containing Amine Ion-Pair Complexes and Compositions Thereof" filed by Debra Caswell on 2-8-88, cofiled with the present U.S. patent application. Still, further improvements in stability of the ion-pair particles in liquid detergent compositions that are aggressive toward ion-pair conditioning particles, such as compositions containing high levels of anionic and nonionic surfactants, fatty builders, and polar solvents, are desirable. Also, higher levels of cleaning performance in conjunction with excellent through-the-wash fabric conditioning are desirable.

It is an object of this invention to provide a liquid detergent composition having excellent cleaning performance and excellent through-the-wash fabric conditioning performance. More specifically, it is an object of this invention to provide a liquid detergent composition as described above wherein the fabric conditioning agent therein comprises amine-organic anion ion-pair complex particles, and wherein the conditioning particles have improved stability, and therefore extended shelf-life, in detergent compositions with exceptional cleaning performance.

SUMMARY OF THE INVENTION

The present invention relates to liquid detergent compositions comprising: (1) a liquid base; (2) from 5.0% to about 40% of a surfactant component selected from alkyl sulfate-containing surfactants and alkyl ethoxylated sulfate-containing surfactants, and mixtures thereof; and (3) from about 0.1% to about 20% of water-insoluble ion-pair conditioning particles having an average diameter of from about 10 to about 500 microns, said particles comprising an amine-organic anion ion-pair complex having the formula:

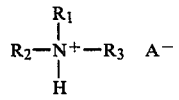

wherein each $R_1$ and $R_2$ can independently be $C_{12}$ to $C_{20}$ alkyl or alkenyl, and $R_3$ is H or $CH_3$, and A is an organic anion selected from the group consisting of alkyl sulfonates, aryl sulfonates, alkylaryl sulfonates, alkyl sulfates, dialkyl sulfosuccinates, alkyl oxybenzene sulfonates, acyl isethionates, acylalkyl taurates, alkyl ethoxylated sulfates, olefin sulfonates, and mixtures of such anions. The detergent composition has a pH of from about 5 to about 10. Optionally, the ion-pair conditioning particles also contain from about 5% to about 95% of an amine-inorganic anion ion-pair complex having the formula:

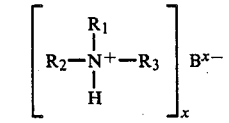

wherein each $R_1$ and $R_2$ can independently be $C_{12}$ to $C_{20}$ alkyl or alkenyl, each $R_3$ is H or $CH_3$, and x corresponds to the molar ratio of the amine to the inorganic anion and the valence of the inorganic anion, x being an integer between 1 and 3, inclusive. B is an inorganic anion such as, but not limited to, sulfate ($SO_4^{-2}$), hydrogen sulfate ($HSO_4^{-1}$), nitrate ($NO_3^-$), phosphate ($PO_4^{-3}$), hydrogen phosphate ($HPO_4^{-2}$), and dihydrogen phosphate ($H_2PO_4^{-1}$), and mixtures thereof, preferably sulfate or hydrogen sulfate. Inclusion of the optional amine-inorganic anion ion-pair complex in the conditioning particles can improve processing characteristics of the particles.

The liquid compositions can additionally contain other surfactants, detergent builders, chelating agents, enzymes, soil release agents, anti-redeposition agents, and other detergent components useful for fabric cleaning or conditioning applications.

It has been observed that common liquid detergent components, including certain polar solvents, surfactants, and builders, can detrimentally affect stability of the amine-organic anion ion-pair conditioning particles, set forth above. It has now surprisingly been discovered that high levels of alkyl sulfate and alkyl ethoxylated sulfate added to the liquid detergent composition promotes stability of the ion-pair conditioning particles.

DETAILED DESCRIPTION OF THE INVENTION

As used herein, the term "liquid detergent composition" shall refer to compositions containing a liquid base, a surfactant component selected from alkyl sulfates and alkyl ethoxylated sulfates, and the ion-pair conditioning particles. As used herein, the term "alkyl sulfate" surfactant shall specifically refer to non-ethoxylated alkyl sulfate surfactants. The liquid detergent composition may optionally contain other surfactants and conditioning agents, and may also contain builders, other cleaning ingredients, or other optional ingredients such as chelating agents, enzymes, soil release agents, and anti-redeposition agents. All percentages set forth below to describe the amount of any particular detergent component in the liquid detergent composition are defined as a weight percentage of the total liquid detergent composition, unless otherwise specifically indicated.

Conditioning Particles

The ion-pair conditioning particles comprise water-insoluble particles comprised of certain amine-organic anion ion-pair complexes and, optionally, certain amine-inorganic anion ion-pair complexes.

The amine-organic anion ion-pair complexes can be represented by the following formula:

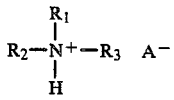

(1)

wherein each $R_1$ and $R_2$ can independently be $C_{12}$ to $C_{20}$ alkyl or alkenyl, and each $R_3$ is H or $CH_3$. A represents an organic anion and includes a variety of anions derived from anionic surfactants, as well as related shorter alkyl or alkenyl chain compounds which need not exhibit surface activity. A is selected from the group consisting of alkyl sulfonates, aryl sulfonates, alkylaryl sulfonates, alkyl sulfates, dialkyl sulfosuccinates, alkyl oxybenzene sulfonates, acyl isethionates, acylalkyl taurates, alkyl ethoxylated sulfates, and olefin sulfonates, and mixtures of such anions.

As used herein the term alkyl sulfonate shall include those alkyl compounds having a sulfonate moiety at a fixed or predetermined location along the carbon chain, as well as compounds having a sulfonate moiety at a random position along the carbon chain.

The optionally incorporated amine-inorganic anion ion-pair complexes can be represented by the following formula:

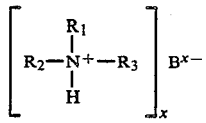

(2)

wherein each $R_1$ and $R_2$ can independently be $C_{12}$ to $C_{20}$ alkyl or alkenyl, each $R_3$ is H or $CH_3$, and x corresponds to the molar ratio of the amine to the inorganic anion and the valence of the inorganic anion, x being an integer between 1 and 3, inclusive. B is an inorganic anion such as, but not limited to, sulfate ($SO_4^{-2}$), hydrogen sulfate ($HSO_4^{-1}$), nitrate ($NO_3^-$), phosphate ($PO_4^{-3}$), hydrogen phosphate ($HPO_4^{-2}$), and dihydrogen phosphate ($H_2PO_4^{-1}$), and mixtures thereof, preferably sulfate or hydrogen sulfate.

It has been found that in order for the conditioning particles of the present invention to impart their fabric care benefits through the wash they should have an average particle diameter of from about 10 to about 500 microns. Preferably the particles have an average diameter of less than about 350 microns, and more preferably less than about 200 microns, and most preferably less than about 150 microns. Also preferably, the particles have an average diameter of greater than about 40 microns, and more preferably greater than about 50 microns. The term "average particle diameter" represents the mean particle size diameter of the actual particles of a given material. The mean is calculated on a weight percent basis. The mean is determined by conventional analytical techniques such as, for example, laser light diffraction or microscopic determination utilizing a scanning electron microscope. Preferably, greater than 50% by weight, more preferably greater than 70% by weight, and most preferably greater than 90% by weight, of the particles have actual diameters which are less than about 500 microns, preferably less than about 350 microns, and more preferably less than about 200 microns. Also preferably, greater than 50% by weight, more preferably greater than 70% by weight, and most preferably greater than 90% by weight, of the particles have actual diameters which are greater than about 10 microns, preferably greater than about 40 microns, and more preferably greater than about 50 microns.

The complexing of an amine with the organic anion and, optionally, with the inorganic anion results in ion-pair entities which are chemically distinct from the respective starting materials. Such factors as the type of amine and the type of organic anion or inorganic anion employed, the ratio of the amine to the organic anion and inorganic anion, in addition to the ratio of amine-organic anion ion-pair complex to amine-inorganic anion ion-pair complex can affect the physical properties of the resulting complexes, including the thermal phase transition points which affects whether the complex has a gelatinous (soft) or solidified (hard) character at a particular temperature. These factors are discussed in more detail below.

The conditioning particles which contain the optional ion-pair complex of Formula (2) preferably contain from about 5% to about 95%, by weight of the particles, of the amine-organic anion ion-pair complex of Formula (1) and from about 95% to about 5% of the amine-inorganic anion ion-pair complex of Formula (2), more preferably between about 40% and about 90% of the Formula (1) complex and between about 60% and about 10% of the Formula (2) complex, even more preferably between about 50% to about 80% of the Formula (1) complex and about 50% to about 20% of the Formula (2) complex, and for highly preferred conditioning particles wherein the Formula (1) complex anion component is a $C_3$ linear alkyl benzene sulfonate (cumene sulfonate), most preferably about 70% of the Formula (1) complex and about 30% of the Formula (2) complex.

The ratio of the Formula (1) complex to Formula (2) complex can affect whether particles containing these ion-pair complexes have a gelatinous (soft) or solidified (hard) character at a particular temperature. By including proportionately more of the ion-pair complex of Formula (2), the particles tend to become more solidified (hard), and therefore easier to form into particles by prilling or mechanical processing. By including proportionately more of the fabric care active ion-pair complex of Formula (1) in the comelt mixtures, particles made from such comelt mixtures tend to have higher fabric care conditioning performance. Thus, the optimal fabric care conditioning agent formulations will involve a balancing of these factors, and will not necessarily be the same for all applications. Such balancing, however, can be performed by one of ordinary skill in the art without undue experimentation.

Starting amines for the Formula (1) ion-pair complex are of the formula:

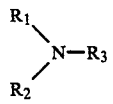

wherein each $R_1$ and $R_2$ are independently $C_{12}$ to $C_{20}$ alkyl or alkenyl, preferably $C_{16}$ to $C_{20}$ alkyl or alkenyl, and most preferably $C_{16}$ to $C_{20}$ alkyl, and $R_3$ is H or $CH_3$. Suitable non-limiting examples of starting amines include ditallow amine, ditallow methyl amine, dipalmityl amine, dipalmityl methyl amine, distearyl amine, distearyl methyl amine, diarachidyl amine, diarachidyl methyl amine, palmityl stearyl amine, palmityl stearyl methyl amine, palmityl arachidyl amine, palmityl arachidyl methyl amine, stearyl arachidyl amine, stearyl arachidyl methyl amine, tallow palmityl amine, tallow palmityl methyl amine, tallow stearyl amine, tallow stearyl methyl amine, tallow arachidyl amine, and tallow arachidyl methyl amine. Most preferred are ditallow amine, distearyl amine, ditallow methyl amine and distearyl methyl amine.

The organic anions (A) useful in the ion-pair complex of the present invention are the alkyl sulfonates, aryl sulfonates, alkylaryl sulfonates, alkyl sulfates, alkyl ethoxylated sulfates, dialkyl sulfosuccinates, alkyl oxybenzene sulfonates, acyl isethionates, acylalkyl taurates, olefin sulfonates, and mixtures thereof.

Preferred organic anions are the $C_1$–$C_{20}$ alkyl sulfonates, $C_1$–$C_{20}$ alkylaryl sulfonates, $C_1$–$C_{20}$ alkyl sulfates, $C_1$–$C_{20}$ alkyl ethoxylated sulfates, aryl sulfonates, and dialkyl sulfosuccinates.

More preferred are the $C_1$–$C_{20}$ alkyl ethoxylated sulfates, $C_1$–$C_{20}$ alkylaryl sulfonates, aryl sulfonates, and dialkyl sulfosuccinates.

Even more preferred are $C_1$–$C_{20}$ alkylaryl sulfonates and aryl sulfonates and especially preferred are benzene sulfonates (as used herein, benzene sulfonates contain no hydrocarbon chain attached directly to the benzene ring) and $C_1$–$C_{13}$ alkylaryl sulfonates, including the $C_1$–$C_{13}$ linear alkyl benzene sulfonates (LAS). The benzene sulfonate moiety of LAS can be positioned at any carbon atom of the alkyl chain, and is commonly at the second carbon atom for alkyl chains containing three or more carbon atoms.

Most preferred organic anions are benzene sulfonates and $C_1$–$C_5$ linear alkylbenzene sulfonates (LAS), particularly $C_1$–$C_3$ LAS.

The anions listed above can generally be obtained in their acid or soluble salt forms from commercial chemical sources such as Aldrich Chemical Co., Inc. in Milwaukee, Wis., Vista Chemical Co. in Ponca, Okla., and Reutgers-Nease Chemical Co. in State College, Pa. Acids of the anions are preferred. The amines can be obtained from Sherex Chemical Corp., in Dublin, Ohio.

Preferred are complexes formed from the combination of ditallow amine complexed with an aryl sulfonate or $C_1$–$C_{20}$ alkylaryl sulfonate, ditallow methyl amine complexed with an aryl sulfonate or a $C_1$–$C_{20}$ alkylaryl sulfonate, distearyl amine complexed with an aryl sulfonate or a $C_1$–$C_{20}$ alkylaryl sulfonate and distearyl methyl amine complexed with an aryl sulfonate or a $C_{1-20}$ alkylaryl sulfonate. Even more preferred are those complexes formed from ditallow amine, ditallow methyl amine, distearyl amine or distearyl methyl amine complexed with a benzene sulfonate or a $C_1$–$C_{13}$ linear alkylbenzene sulfonate (LAS). Even more preferred are complexes formed from ditallow amine, ditallow methyl amine, distearyl amine or distearyl methyl amine complexed with a benzene sulfonate or a $C_1$–$C_5$ linear alkylbenzene sulfonate. Most preferred are complexes formed from ditallow amine, ditallow methyl amine, distearyl amine or distearyl methyl amine complexed with $C_1$–$C_3$ LAS.

Starting amines for the optional Formula (2) ion-pair complexes are of the formula:

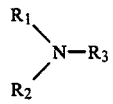

wherein each $R_1$ and $R_2$ are independently $C_{12}$ to $C_{20}$ alkyl or alkenyl, preferably $C_{16}$ to $C_{20}$ alkyl or alkenyl, and most preferably $C_{16}$ to $C_{20}$ alkyl, and each $R_3$ is H or $CH_3$. Suitable non-limiting examples of starting amines for the Formula (2) complexes include ditallow amine, ditallow methyl amine, dipalmityl amine, dipalmityl methyl amine, distearyl amine, distearyl methyl amine, diarachidyl amine, diarachidyl methyl amine, palmityl stearyl amine, palmityl stearyl methyl amine, palmityl arachidyl amine, palmityl arachidyl methyl amine, stearyl arachidyl amine, stearyl arachidyl methyl amine, tallow palmityl amine, tallow palmityl methyl amine, tallow stearyl amine, tallow stearyl methyl amine, tallow arachidyl amine, and tallow arachidyl methyl amine.

The inorganic anion component of the amine-inorganic anion ion-pair complex can be obtained from inorganic acids, including acids having monovalent, divalent, and trivalent anions such as, but not limited to, nitric acid, sulfuric acid, and phosphorous acid. Especially preferred is sulfuric acid. These acids are commonly available from chemical supply companies, including Aldrich Chemical Company, Inc., Milwaukee, Wis., and Sigma Chemical Company, St. Louis, Mo.

The fabric care agent of the present invention can comprise particles which contain both the amine-organic anion ion-pair complex of Formula 1 and the amine-inorganic anion ion-pair complex of Formula 2. These two types of ion-pair complexes are physically combined in a way such that particles can be formed which comprise said combination of ion-pair complexes. This can be accomplished by separately forming each type of ion-pair complex, and then physically combining them by mixing the two molten ion-pair complexes together. Another method for providing a mixture of the two types of ion-pair complexes is to form said complexes conjointly, for example by preparing a melt containing the organic anion component, A, the inorganic anion component, B, and a sufficient amount of the amine components to form the desired levels of each type of ion-pair complex.

The amine and organic anion are combined in a molar ratio of amine to anionic compound ranging from about 10:1 to about 1:2, preferably from about 5:1 to about 1:2, more preferably from about 2:1 to 1:2 and most preferably about 1:1. For the preferred amine-organic anion/amine-inorganic anion conditioning particles wherein the organic anion is $C_1$–$C_3$LAS and the inorganic anion is the divalent sulfate anion, the amine and inorganic anion are combined in a molar ratio ranging from about 10:1 to about 1:2, preferably from about 5:1 to about 1:2, more preferably from about 3:1 to about 1:1, and most preferably about 2:1. The amine quantity indicated in the above ratios is based upon separate preparation of the Formula 1 and Formula 2 ion-pair complexes. Accordingly, when the Formula 1 and Formula 2 ion-pair complexes are formed conjointly, the molar ratio of amine to organic anion to inorganic anion will depend on the preferred ratio of the Formula (1) and Formula (2) complexes. For example, for the highly preferred ditallow amine-$C_3$LAS/ditallow amine-sulfate comelt utilized in a 70:30 weight ratio of ditallow amine-$C_3$LAS to ditallow amine-sulfate, the molar ratios of the ditallow amine $C_3$LAS, and sulfate in the starting materials will be about 5.7:3.7:1.0.

Another method of forming the conditioning particles is to heat the amine to a liquid state, add the desired amounts of this molten amine component to separate heated acidified aqueous solutions of the organic anion and the inorganic anion, and then extract the ion-pair complexes by using a solvent, such as chloroform. Alternatively, the molten amine can be added to a mixture of heated acidified aqueous solutions of the organic anion and inorganic anion, followed by solvent extraction.

The desired particle sizes can be achieved by, for example, mechanically grinding the ion-pair complexes in blenders (e.g., an Oster® blender) or in large scale mills (e.g., a Wiley® Mill) to the desired particle size range. Preferably, the particles are formed by prilling in a conventional manner, such as by hydraulically forcing a comelt of the ion-pair complexes through a heated nozzle. Prior to passage through the nozzle, the comelt should be in a well-mixed condition, for example by continuously circulating the comelt through a loop at sufficient velocity to prevent settling. As an alternative to hydraulically forcing the comelt through the nozzle, air injection can be used to pass the comelt through the nozzle. Particle diameters within the preferred ranges can be obtained directly from the prilling apparatus or, when additional control over average particle is desired, such desired particle size can be obtained by conventional screening techniques. Comelts of complexes which are gelatinous (ie, soft) at room temperature can be mechanically ground to achieve the desired particle size after flash freezing by using, for example, liquid nitrogen. The particles can then be incorporated into a liquid delivery system, such as a detergent base or an aqueous base useful for forming an aqueous dispersion of the particles. Alternately, the comelt can be added to the liquid delivery system, such as a detergent base, and then be formed into particles by high shear mixing.

The complexes can be characterized for the purposes of this invention by their thermal phase transition points. As used hereafter, the thermal phase transition (hereinafter alternately referred to as "transition point") shall mean the temperature at which the complex exhibits softening (solid to liquid crystal phase transition) or melting (solid to isotropic phase transition) whichever occurs first upon heating. The transition point temperatures can be determined by differential scanning colorimetry (DSC) and/or polarized light microscopy. The first transition point of solid particles made from the ion-pair complex or mixture of ion-pair complexes will preferably be between about 10° C. and about 100° C., more preferably between about 30° C. and about 100° C., and most preferably between about 35° C. and about 80° C.

With respect to the amine-organic anion ion-pair complexes, generally shorter alkyl or alkenyl chain length anions will form complexes with higher transition points than complexes that are identical except for having an anion with a longer chain length. Highly preferred ion-pairs are made with $C_1$–$C_{13}$ LAS or benzene sulfonate and generally have transition points in the range of 10° C.–100° C. The amine-organic anion ion-pair complexes made with $C_6$–$C_{13}$ LAS generally have first transition points in the range of about 15° C. to about 30° C. and tend to be gelatinous (soft). The amine-organic anion ion-pair complexes made with $C_1$–$C_5$ LAS and benzene sulfonate (i.e., no alkyl chain) generally have first transition points in the range of about 30° C. to about 100° C. and tend to be more solidified (hard), and therefore tend to form comelted amine-organic anion ion-pair complexes or amine-organic anion/amine-inorganic anion ion-pair complex mixtures that and more susceptible to prilling.

Preferred conditioning particles are made with organic anion components derived from $C_1$–$C_3$ LAS and have transition points, apart from the amine-inorganic anion ion-pair complex, in the range of about 35° C. to about 100° C.

Preferred amine-organic anion ion-pair complexes include those comprised of a ditallow amine, ditallow methyl amine, distearyl amine or distearyl methyl amine complexed with a $C_1$ to $C_3$ LAS in a 1:1 molar ratio. These complexes have transition points generally between about 35° C. and about 100° C. The preferred amine-inorganic anion ion-pair complexes for use with the preferred amine-organic anion ion-pair complexes include ditallow amine, ditallow methyl amine, distearyl amine and distearyl methyl amine complexed with sulfate in a 2:1 molar ratio.

The temperature ranges listed above are approximate in nature, and are not meant to exclude complexes outside of the listed ranges. Further, it should be understood that the particular amine of the ion-pair complex can affect the transition point. For example, for the same anionic compound, distearyl amines will form harder ion-pair complexes than ditallow amines, and ditallow amines will form harder ion-pair complexes than ditallow methyl amines.

The ideal conditioning particle is sufficiently large so as to become entrapped in fabrics during washing, and has a transition point which is low enough that at least a substantial part of the particle, preferably the entire particle, will soften or melt at conventional automatic laundry dryer temperatures, but not so low that it will melt during the fabric wash or rinse stages.

The ion-pair conditioning particles can be incorporated into detergent compositions or used in the presence of detergent compositions, with little, if any, detrimental effect on cleaning. These conditioning particles provide conditioning benefits across a variety of laundry conditions, including machine or hand washing followed by machine drying and also machine or hand washing followed by line drying. Additionally, these same conditioning agents can be used with a variety of surfactant systems.

The conditioning particles are typically used herein at levels of about 0.1% to about 20.0%, preferably 0.1% to about 10%, of a liquid detergent composition with which the conditioning particles are used in the presence of, or incorporated in. Detergent composition components are described below.

Liquid Base

The liquid detergent compositions of the present invention have a liquid base component which functions as a carrier and diluent of the other detergent components. The liquid base is preferably water or other polar solvents, or mixtures thereof. Exemplary nonlimiting polar solvents, in addition to water, include low molecular weight primary and secondary monohydric alcohols such as methanol, ethanol, and isopropanol, and polyols containing from about 2 to about 6 carbon atoms and from about 2 to about 6 hydroxy groups such as propylene glycol, ethylene glycol, glycerine, and 1,3-propanediol. Typically, the liquid detergent composition will contain between about 30% and about 80% of the liquid base, and preferably will contain between about 20% and about 70% water.

Alkyl Sulfate/Alkyl Ethoxylated Sulfate Surfactant Component

The detergent compositions of the present invention have as an essential element alkyl sulfate/alkyl ethoxylated sulfate surfactant component. This surfactant component can comprise alkyl sulfate (i.e., nonethoxylated alkyl sulfate) and/or alkyl ethoxylated sulfate surfactants. These surfactants typically have from about 10 to about 20 carbon atoms in the alkyl or hydroxyalkyl group, and can have the formula $RO(C_2H_4O)_mSO_3M$ wherein R is a $C_{10}$–$C_{20}$ alkyl or hydroxyalkyl group having a $C_{10}$–$C_{20}$ alkyl component, preferably a $C_{12}$–$C_{16}$ alkyl or hydroxyalkyl, more preferably $C_{12}$–$C_{15}$ alkyl or hydroxyalkyl, M is from 0 (inclusive) to about 4, and M is a cation which can be, for example, an alkali metal cation (e.g., sodium, potassium, lithium), ammonium or substituted-ammonium cation. Specific examples of substituted ammonium cations include methyl-, dimethyl-, and trimethyl-ammonium cations and quaternary ammonium cations such as tetramethylammonium and dimethyl piperidinium cations and those derived from alkylamines such as ethylamine, diethylamine, triethylamine, mixtures thereof, and the like, said salt preferably being an olefin sulfonate salt having from about 12 to about 24 carbon atoms. For alkyl sulfates, m will be 0. For surfactant components containing alkyl ethoxylated sulfates, m will typically be between about 0.5 and about 4, preferably between about 0.5 and about 3. Examples of preferred surfactants in the surfactant component are $C_{12}$–$C_{16}$ nonethoxylated alkyl sulfate ($C_{12-16}E(0)M$), $C_{12}$–$C_{16}$ alkyl polyethoxylate (1.0) sulfate ($C_{12-16}E(1.0)M$), $C_{12}$–$C_{16}$ alkyl polyethoxylate (2.25) sulfate ($C_{12-16}E(2.25)M$), $C_{12}$–$C_{16}$ alkyl polyethoxylate (3.0) sulfate ($C_{12-16}E(3.0)M$), and $C_{12}$–$C_{16}$ alkyl polyethoxylate (4.0) sulfate ($C_{12-16}E(4.0)M$), wherein M is selected from sodium and potassium.

The alkyl sulfate/alkyl ethoxylated sulfate surfactant component can be prepared by sulfating a nonethoxylated straight or branched chain alcohol having an alkyl group containing from about 10 to 18 carbon atoms, preferably from about 12 to about 16 carbon atoms, or by sulfating an ethoxylated alcohol having an alkyl group containing from about 10 to about 18 carbon atoms, preferably from about 12 to about 16 carbon atoms, or by sulfating a mixture of such nonethoxylated and ethoxylated alcohols. Nonethoxylated alcohols as described above are commonly available. The ethoxylated alcohols described above are preferably produced by first ethoxylating a nonethoxylated alcohol (described above) with an average of about 0.5 to about 4, preferably from about 0.5 to about 3, moles of ethylene oxide per mole of alcohol, by a conventional alkaline-catalyzed ethoxylation reaction. The alkyl sulfate and/or alkyl ethoxylated sulfate should, as a final step, be neutralized with an appropriate base.

Typically, the surfactant component which contains alkyl ethoxylated sulfate will also contain some alkyl sulfate, due to incomplete ethoxylation of the alcohol. The products obtained will also typically have a mixture of alkyl or alkyl ethoxylate chain lengths. The alkyl sulfates and/or alkyl ethoxylated sulfates of the surfactant component are used as water soluble or dispersible salts, preferably sodium, potassium, ammonium, monethanol ammonium, diethanol ammonium, triethanol ammonium, or magnesium salts, or mixtures thereof.

A particularly preferred anionic surfactant is the sodium salt of the sulfated reaction product of a mixture of fatty alcohols containing from about 14 to about 15 carbon atoms with approximately 0.5 to approximately 3.0 moles of ethylene oxide.

The liquid detergent compositions of this invention will contain at least 5.0% and less than about 40% of the surfactant component, preferably less than about 25% of the surfactant component. The upper limit of 40% is merely a practical limit due in part of sudsing which is typically imparted by alkyl sulfate/alkyl ethoxylated sulfate surfactants upon agitation. Anti-sudsing agents discussed in more detail below, can be utilized to control sudsing, and will be desirable particularly when the surfactant component content is above about 25%.

Anti-Sudsing Agents

Non-soap suds suppressors are preferred, although fatty acid such as hardened marine oil fatty acids (predominantly $C_{18}$ to $C_{20}$) can be used.

Preferred suds suppressors comprise silicones. In particular there may be employed a particulate suds suppressor comprising silicone and silanated silica releasably enclosed in water soluble or dispersible substantially non-surface active detergent impermeable carrier. Suds suppressing agents of this sort are disclosed in British Pat. No. 1,407,997. A suitable suds suppressing product comprises 7% silica/silicone (15% by weight silanated silica, 85% silicone, obtained from Dow Corning), 65% sodium tripolyphosphate, 25% tallow alcohol condensed with 25 molar proportions of ethylene oxide, and 3% moisture. The amount of silica/silicone suds suppressor employed depends upon the degree of suds suppression desired but it is often in the range from 0.01% to 0.5% by weight of the detergent composition. Other suds suppressors which may be used are water insoluble waxes, preferably microcrystalline, having melting point in the range from 35° to 125° C. and saponification value less than 100, as described in British Pat. No. 1,492,938.

Yet other suitable suds suppressing systems are mixtures of hydrocarbon oil, a hydrocarbon wax and hydrophobic silica as described in published European patent application No. 0000216 and, especially, particulate suds suppressing compositions comprising such mixtures, combined with a nonionic ethoxylate having hydrophilic lipophilic balance in the range from 14–19 and a compatibilising agent capable of forming inclusion compounds, such as urea. These particulate suds suppressing compositions are described in European published patent application No. 0008830.

Detergent Surfactant System

The amount of total detergent surfactant (including the alkyl sulfate and/or alkyl ethoxylated sulfate surfactant) included in detergent compositions of the present invention can vary from about 1% to about 98% by weight of the composition, depending upon the particular surfactant(s) used and the effects desired. Preferably, the total detergent surfactant(s) comprises from about 10% to about 60% by weight of the composition. Combinations of anionic, cationic and nonionic surfactants, in addition to the anionic alkyl sulfates and alkyl ethoxylated sulfates discussed above as part of the essential surfactant component, can be used. Liquid detergent compositions preferably contain primarily anionic surfactants or combinations of anionic and nonionic surfactants. Preferred optional anionic surfactants for liquid detergent compositions include linear alkyl benzene sulfonates. Preferred nonionic surfactants include alkyl polyethoxylated alcohols.

Other classes of surfactants, such as semi-polar, ampholytic, zwitterionic, or cationic surfactants can be used. Mixtures of these surfactants can also be used.

A. Additional Anionic Detergent Surfactants

Consistent with the art pertaining to detergent surfactants, liquid detergents typically incorporate stable acid forms of the surfactants.

Optional anionic detergent surfactants suitable for use in the present invention as detergent surfactants include sulfonates such as those generally disclosed in U.S. Pat. No. 3,929,678, Laughlin et al., issued Dec. 30, 1975, at column 23, line 58 through column 29, line 23 and in U.S. Pat. No. 4,294,710, Hardy et al., issued Oct. 13, 1981, both of which are incorporated herein by reference. Classes of useful anionic surfactants include:

1. Ordinary alkali metal soaps, such as the sodium, potassium, ammonium and alkylolammonium salts of higher fatty acids containing from about 8 to about 24 carbon atoms, preferably from about 10 to about 20 carbon atoms. Preferred alkali metal soaps are sodium laurate, sodium stearate, sodium oleate and potassium palmitate.

2. Water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.)

Examples of this group of anionic surfactants are the sodium and potassium alkylbenzene sulfonates in which the alkyl group contains from about 9 to about 15 carbon atoms, in straight chain or branched chain configuration, e.g., those of the type described in U.S. Pat. No. 2,220,099, Guenther et al., issued Nov. 5, 1940, and U.S. Pat. No. 2,477,383, Lewis, issued Dec. 26, 1946. Especially useful are linear straight chain alkylbenzene sulfonates in which the average number of carbon atoms in the alkyl group is from about 11 to about 13, abbreviated as $C_{11}$–$C_{13}$LAS.

Other anionic surfactants include sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms.

Also included are water-soluble salts of esters of alpha-sulfonated fatty acids containing from about 6 to about 20 carbon atoms in the fatty acid group and from about 1 to about 10 carbon atoms in the ester group; water-soluble salts of 2-acyloxyalkane-1-sulfonic acids containing from about 2 to about 9 carbon atoms in the acyl group and from about 9 to about 23 carbon atoms in the alkane moiety; and beta-alkyloxy alkane sulfonates containing from about 1 to about 3 carbon atoms in the alkyl group and from about 8 to about 20 carbon atoms in the alkane moiety. Useful alkylether sulfates are described in detail in U.S. Pat. No. 4,807,219, to Hughes, issued Mar. 26, 1985, which is incorporated herein by reference. The above surfactant preferably represents from about 8% to about 18%, by weight (on an acid basis) of the composition, more preferably from about 9% to about 14%.

Preferred optional anionic surfactants for use in liquid detergent compositions are linear $C_{11}$ to $C_{13}$ alkyl benzene sulfonates.

3. Anionic phosphate surfactants.

4. N-alkyl substituted succinamates.

B. Nonionic Detergent Surfactants

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Classes of useful nonionic surfactants include:

1. The polyethylene oxide condensates of alkyl phenols. These compounds include the condensation products of alkyl phenols having an alkyl group containing from about 6 to about 12 carbon atoms in either a straight chain or branched chain configuration with ethylene oxide, the ethylene oxide being present in an amount equal to from about 5 to about 25 moles of ethylene oxide per mole of alkyl phenol. Examples of compounds of this type include nonyl phenol condensed with about 9.5 moles of ethylene oxide per mole of phenol; dodecyl phenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal TM CO-630, marketed by the GAF Corporation; and Triton# X-45, X-114, X-100, and X-102, all marketed by the Rohm & Haas Company.

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 4 to about 10 moles of ethylene oxide per mole of alcohol. Examples of such ethoxylated alcohols include the condensation product of myristyl alcohol with about 10 moles of ethylene oxide per mole of alcohol; and the condensation product of coconut alcohol (a mixture of fatty alcohols with alkyl chains varying in length from 10 to 14 carbon atoms) with about 9 moles of ethylene oxide. Examples of commercially available nonionic surfactants of this type include Tergitol TM 15-S-9 (the condensation product of $C_{11}$–$C_{15}$ linear alcohol with 9 moles ethylene oxide), Tergitol TM 24-L-6 NMW (the condensation product of $C_{12}$–$C_{14}$ primary alcohol with 6 moles ethylene oxide with a narrow molecular weight distribution), both marketed by Union Carbide Corporation; Neodol TM 45-9 (the condensation product of $C_{14}$–$C_{15}$ linear alcohol with 9 moles of ethylene oxide), Neodol TM 23-6.5 (the condensation product of $C_{12}$–$C_{13}$ linear alcohol with 6.5 moles of ethylene oxide), Neodol TM 45-7 (the condensation product of $C_{14}$–$C_{15}$ linear alcohol with 7 moles of ethylene oxide), Neodol TM 45-4 (the condensation product of $C_{14}$–$C_{15}$ linear alcohol with 4 moles of ethylene oxide), marketed by Shell Chemical Company, and Kyro TM EOB (the condensation product of $C_{13}$–$C_{15}$ alcohol with 9 moles ethylene oxide), marketed by The Procter & Gamble Company.

3. The condensation products of ethylene oxide with a hydrophobic base formed by the condensation of propylene oxide with propylene glycol. The hydrophobic portion of these compounds has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic TM surfactants, marketed by Wyandotte Chemical Corporation.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic TM compounds, marketed by Wyandotte Chemical Corporation.

5. Semi-polar nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Preferred semi-polar nonionic detergent surfactants are the amine oxide surfactants having the formula $$R^3(OR^4)_xN(\rightarrow O)(R^5)_2$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

Preferred amine oxide surfactants are $C_{10}$–$C_{18}$ alkyl dimethyl amine oxides and $C_8$–$C_{12}$ alkoxy ethyl dihydroxy ethyl amine oxides.

6. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.5 to about 10, preferably from about 1.5 to about 3, most preferably from about 1.6 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

7. Fatty acid amide surfactants having the formula:

$$R^6-\overset{\overset{\displaystyle O}{\|}}{C}-N(R^7)_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3.

Preferred amides are $C_8$–$C_{20}$ ammonia amides, monoethanolamides, diethanolamides, and isopropanolamides.

C. Ampholytic Surfactants

Ampholytic surfactants can be broadly described as aliphatic derivatives of secondary or tertiary amines, or aliphatic derivatives of heterocyclic secondary and tertiary amines in which the aliphatic radical can be straight or branched chain and wherein one of the aliphatic substituents contains from about 8 to about 18 carbon atoms and at least one of the aliphatic substituents contains an anionic water-solubilizing group, e.g., carboxy, sulfonate, sulfate. See U.S. Pat. No. 3,929,678, Laughlin et al., issued Dec. 30, 1975, column 19, line 38 through column 22, line 48, incorporated herein by reference, for examples of ampholytic surfactants useful herein.

D. Zwitterionic Surfactants

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678, Laughlin et al., issued Dec. 30, 1975, column 19, line 38 through column 22, line 48, incorporated herein by reference, for examples of zwitterionic surfactants useful herein.

E. Cationic Surfactants

Cationic surfactants are the least preferred detergent surfactants useful in detergent compositions of the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solutions pH values less than about 8.5.

Suitable cationic surfactants include the quaternary ammonium surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain; each $R^3$ is independently selected from the group consisting of $-CH_2CH_2-$, $-CH_2CH(CH_3)-$, $-CH_2CH(CH_2OH)-$, and $-CH_2CH_2CH_2-$; each $R^4$ is independently selected from the group consisting of $C_1$–$C_4$ alkyl, $C_1$–$C^4$ hydroxyalkyl, benzyl, ring structures formed by joining the two $R^4$ groups, $-CH_2CHOHCHOHCOR^6CHOHCH_2OH$ wherein $R^6$ is any hexose or hexose polymer having a molecular weight less tha about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Preferred examples of the above compounds are the alkyl quaternary ammonium surfactants, especially the mono-long chain alkyl surfactants described in the above formula when $R^5$ is selected from the same groups as $R^4$. The most preferred quaternary ammonium surfactants are the chloride, bromide and methylsulfate $C_8$–$C_{16}$ alkyl trimethylammonium salts, $C_8$–$C_{16}$ alkyl di(hydroxyethyl)methylammonium salts, the $C_8$–$C_{16}$ alkyl hydroxyethyldimethylammonium salts, and $C_8$–$C_{16}$ alkyloxypropyltrimethylammonium salts. Of the above, decyl trimethylammonium methylsulfate, lauryl trimethylammonium chloride, myristyl trimethylammonium bromide and coconut trimethylammonium chloride and methylsulfate are particularly preferred.

A more complete disclosure of these and other cationic surfactants useful herein can be found in U.S. Pat. No. 4,228,044, Cambre, issued Oct. 14, 1980, incorporated herein by reference.

Detergent Builders

Detergent compositions of the present invention optionally contain inorganic and/or organic detergent builders to assist in mineral hardness control. These builders comprise from 0% to about 80% by weight of the compositions, preferably rom about 5% to about 50%, more preferably about 5% to about 30%, by weight of detergent builder.

Useful water-soluble organic builders for liquid detergent compositions include carboxylic acids, alkali metal, ammonium and substituted ammonium polyacetates, polycarboxylates and polyhydroxysulfonates. Useful monocarboxylic fatty acids include the $C_{10}$–$C_{18}$ alkyl monocarboxylic (fatty) acids and salts thereof. These fatty acids can be derived from animal and plant fats and oils, such as tallow, coconut oil palm oil and palm kernel oil. Suitable saturated fatty acids can also be synthetically prepared (e.g., via the oxidation of petroleum or by hydrogenation of carbon monoxide via the Fisher-Tropsch process). Examples of suitable saturated fatty acids also include capric, lauric, and myristic fatty acids, and mixture thereof such as about 5:1 to about 1:1 (preferably about 3:1) weight ratios of lauric acid to myristic acid. Unsaturated fatty acids, for example oleic acid, can also be added to such saturated fatty acids. Particularly preferred $C_{10}$–$C_{18}$ alkyl monocarboxylic acids are saturated coconut fatty acids, palm kernel fatty acids, and mixtures thereof.

When present, fatty acids will typically comprise from about 0.5% 0% to about 20%, total composition weight basis, of preferably saturated $C_{10}$–$C_{14}$ fatty acids. Most preferably, the weight ratio of $C_{10}$–$C_{12}$ fatty acid to $C_{14}$ fatty acid is preferably at least 1:1.

Examples of polyacetate and polycarboxylate builders are the sodium, potassium, lithium, ammonium and substituted ammonium salts of ethylenediamine tetraacetic acid, nitrilotriacetic acid, oxydisuccinic acid, mellitic acid, benzene polycarboxylic acids, and citrate. The citrate (preferably in the form of an alkali metal or alkanolammonium salt) is generally added to the composition as citric acid, but can be added in the form of a fully neutralized salt.

Highly preferred polycarboxylate builders are disclosed in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other builders include the carboxylated carbohydrates disclosed in U.S. Pat. No. 3,723,322, Diehl, issued Mar. 28, 1973, incorporated herein by reference.

A class of useful phosphorus-free detergent builder materials have been found to be ether polycarboxylates. A number of ether polycarboxylates have been disclosed for use as detergent builders. Examples of useful ether polycarboxylates include oxydisuccinate, as disclosed in Berg, U.S. Pat. No. 3,128,287, issued Apr. 7, 1964, and Lamberti et al, U.S. Pat. No. 3,635,830, issued Jan. 18, 1972, both of which are incorporated herein by reference.

A specific type of ether polycarboxylates useful as builders in the present invention are those having the general formula:

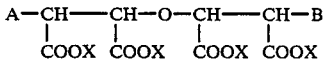

wherein A is H or OH; B is H or

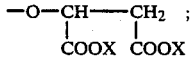

and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is

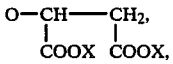

then the compound is tartrate disuccinic acid (TDS) and its water-soluble salts. Mixtures of these builders are especially preferred for use herein. Particularly preferred are mixtures of TMS and TDS in a weight ratio of TMS to TDS of from about 97:3 to about 20:80. These builders are disclosed in U.S. Pat. No. 4,663,071, issued to Bush et al., on May 5, 1987.

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Other useful detergency builders include the ether hydroxypolycarboxylates represented by the structure:

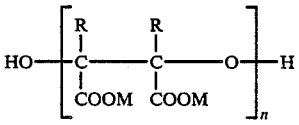

wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen).

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986, incorporated herein by reference. Other useful builders include the $C_5$–$C_{20}$ alkyl succinic acids and salts thereof. A particularly preferred compound of this type is dodecenylsuccinic acid.

Useful builders also include sodium and potassium carboxymethyloxymalonate, carboxymethyloxysuccinate, cis-cyclohexanehexacarboxylate, cis-cyclopentanetetracarboxylate phloroglucinol trisulfonate, water-soluble polyacrylates (having molecular weights of from about 2,000 to about 200,000, for example), and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Useful builders also include alkyl succinates of the general formula R—CH(COOH)$CH_2$(COOH) i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include: lauryl succinate, myristyl succinate, palmityl succinate, 2-dodecenyl succinate (preferred), 2-pentadecenyl succinate, and the like.

Other useful detergency builder materials are the "seeded builder" compositions disclosed in Belgian Pat. No. 798,856, published Oct. 29, 1973, incorporated herein by reference. Specific examples of such seeded builder Imixtures are 3:1 wt. mixtures of sodium carbonate and calcium carbonate having 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

Chelating Agents

The detergent compositions herein may also optionally contain one or more iron and manganese chelating agents. Such chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents in compositions of the invention have one or more, preferably at least two, units of the substructure

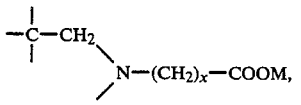

wherein M is hydrogen, alkali metal, ammonium or substituted ammonium (e.g. ethanolamine) and x is from 1 to about 3, preferably 1. Preferably, these amino carboxylates do not contain alkyl or alkenyl groups with more than about 6 carbon atoms. Operable amine carboxylates include ethylenediaminetetraacetates, N-hydroxyethylethylenediaminetriacetates, nitrilotriacetates, ethylenediamine tetraproprionates, triethylenetetraaminehexaacetates, diethylenetriaminepentaacetates, and ethanoldiglycines, alkali metal, ammonium, and substituted ammonium salts thereof and mixtures thereof.

Amino phosphonates are also suitable for use as chelating agents in the compositions of the invention when at least low levels of total phosphorus are permitted in detergent compositions. Compounds with one or more, preferably at least two, units of the substructure

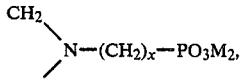

wherein M is hydrogen, alkali metal, ammonium or substituted ammonium and x is from 1 to about 3, preferably 1, are useful and include ethylenediaminetetrakis (methylenephosphonates), nitrilotris (methylenephosphonates) and diethylenetriaminepentakis (methylenephosphonates). Preferably, these amino phosphonates do not contain alkyl or alkenyl groups with more than about 6 carbon atoms. Alkylene groups can be shared by substructures.

Polyfunctionally-substituted aromatic chelating agents are also useful in the compositions herein. These materials comprise compounds having the general formula

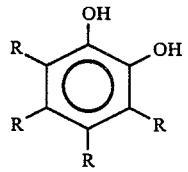

wherein at least one R is —$SO_3H$ or —COOH or soluble salts thereof and mixtures thereof. U.S. Pat. No. 3,812,044, issued May 21, 1974, to Connor et al., incorporated herein by reference, discloses polyfunctionally-substituted aromatic chelating and sequestering agents. Preferred compounds of this type in acid form are dihydroxydisulfobenzenes and 1,2-dihydroxy-3,5-disulfobenzene or other disulfonated catechols in particular. Alkaline detergent compositions can contain these materials in the form of alkali metal, ammonium or substituted ammonium (e.g. mono-or triethanol-amine) salts.

If utilized, these chelating agents will generally comprise from about 0.1% to about 10% by weight of the detergent compositions herein. More preferably chelating agents will comprise from about 0.1% to about 3.0% by weight of such compositions.

Soil Release Agent

Polymeric soil release agents useful in the present invention include cellulosic derivatives such as hydroxyether cellulosic polymers, copolymeric blocks of ethylene terephthalate and poly ethylene oxide or polypropylene oxide terephthalate, and cationic guar gums, and the like.

The cellulosic derivatives that are functional as soil release agents are commercially available and include hydroxyethers of cellulose such as Methocel ® (Dow) and cationic cellulose ether derivatives such as Polymer JR-124 ®, JR-400 ®, and JR-30M ® (Union Carbide). See also U.S. Pat. No. 3,928,213 to Temple et al., issued Dec. 23, 1975, which is incorporated by reference.

Other effective soil release agents are cationic guar gums such as Jaguar Plau ® (Stein Hall) and Gendrive 458 ® (General Mills).

Preferred cellulosic soil release agents for use herein are selected from the group consisting of methyl cellulose; hydroxypropyl methylcellulose; hydroxybutyl methylcellulose; or a mixture thereof, said cellulosic polymer having a viscosity in aqueous solution at 20° C. of 15 to 75,000 centipoise.

A more preferred soil release agent is a copolymer having random blocks of ethylene terephthalate and polyethylene oxide (PEO) terephthalate. More specifically, these polymers are comprised of repeating units of ethylene terephthalate and PEO terephthalate in a mole ratio of ethylene terephthalate units to PEO terephthalate units of from about 25:75 to about 35:65, said PEO terephthalate units containing polyethylene oxide having molecular weights of from about 300 to about 2000. The molecular weight of this polymeric soil release agent is in the range of from about 25,000 to about 55,000. See U.S. Pat. No. 3,959,230 to Hays, issued May 25, 1976, which is incorporated by reference. See also U.S. Pat. No. 3,893,929 to Basadur issued July 8, 1975 (incorporated by reference) which discloses similar copolymers. Surprisingly, it has been found that these polymeric soil release agents balance the distribution of the fabric care agent of the present invention against a broad range of synthetic fabrics such as polyesters, nylons, poly cottons and acrylics. This more uniform distribution of the fabric care agent can result in improved fabric care qualities.

Another preferred polymeric soil release agent is a crystallizable polyester with repeat units of ethylene terephthalate units containing 10–15% by weight of ethylene terephthalate units together with 90–80% by weight of polyoxyethylene terephthalate units, derived from a polyoxyethylene glycol of average molecular weight 300–5,000, and the mole ratio of ethylene terephthalate units to polyoxyethylene terephthalate units in the crystallizable polymeric compound is between 2:1 and 6:1. Examples of this polymer include the commercially available material Zelcon® 5126 (from Dupont) and Milease® T (from ICI).

The foregoing polymers and methods of their preparation are more fully described in European patent application No. 185,417, Gosselink, published June 25, 1986, which is incorporated herein by reference.

If utilized, these soil release agents will generally comprise from about 0.01% to about 5.0% by weight of the detergent compositions herein, more preferably soil release agents will comprise from about 0.2% to about 3.0% by weight of such compositions.

Clay Soil Removal/Anti-redeposition Agents

The compositions of the present invention can also optionally contain water-soluble ethoxylated amines having clay soil removal and anti-redeposition properties. The liquid detergent compositions, preferably about 0.01% to about 5%. These compounds are selected from the group consisting of:

(1) ethoxylated monoamines having the formula:

$$(X-L-)-N-(R^2)_2$$

(2) ethoxylated diamines having the formula:

$$R^2-\underset{\substack{|\\L\\|\\X}}{N}-R^1-\underset{\substack{|\\L\\|\\X}}{N}-R^2 \quad (R^2)_2-\underset{\substack{|\\L\\|\\X}}{N}-R^1-N-(R^2)_2$$

or $$(X-L)_2N-R^1-N-(R^2)_2$$

(3) ethoxylated polyamines having the formula:

$$R^3-[(A^1)_q-(R^4)_t-\overset{\overset{R^2}{|}}{N}-L-X]_p$$

(4) ethoxylatd amine polymers having the general formula:

$$[(R^2)_2-N\underset{w}{\}}R^1-N\underset{x}{\}}R^1-\underset{\substack{|\\L\\|\\X}}{N}\underset{y}{\}}R^1-\overset{\overset{R^2}{|}}{N}-L-X)_z$$

and (5) mixtures thereof; wherein $A^1$ is $$-\overset{\overset{O}{\|}}{N}\underset{\underset{R}{|}}{C}-,\ -\overset{\overset{O}{\|}}{N}\underset{\underset{R}{|}}{C}O-,\ -\overset{\overset{O}{\|}}{N}\underset{\underset{R\ R}{|\ |}}{C}N-,\ -\overset{\overset{O}{\|}}{C}\underset{\underset{R}{|}}{N}-,\ -\overset{\overset{O}{\|}}{O}\underset{\underset{R}{|}}{C}N-,$$

$$-\overset{\overset{O}{\|}}{C}O-,\ -\overset{\overset{O}{\|}}{O}CO-,\ -\overset{\overset{O}{\|}}{O}C-,\ -\overset{\overset{O}{\|}}{C}\underset{\underset{R}{|}}{N}\overset{\overset{O}{\|}}{C}-,$$

or —O—; R is H or $C_1$–$C_4$ alkyl or hydroxyalkyl; $R^1$ is $C_2$–$C_{12}$ alkylene, hydroxyalkylene, alkenylene, arylene or alkarylene, or a $C_2$–$C_3$ oxyalkylene moiety having from 2 to about 20 oxyalkylene units provided that no O—N bonds are formed; each $R^2$ is $C_1$–$C_4$ or hydroxyalkyl, the moiety —L—X, or two $R^2$ together form the moiety $-(CH_2)_r-$, $-A^2-(CH_2)_s-$, wherein $A^2$ is —O— or $-CH_2-$, r is 1 or 2, s is 1 or 2, and r+s is 3 or 4; X is a nonionic group, an anionic group or mixture thereof; $R^3$ is a substituted $C_3$–$C_{12}$ alkyl, hydroxyalkyl, alkenyl, aryl, or alkaryl group having p usbstitution sites; $R^4$ is $C_1$–$C_{12}$ akylene, hydroxyalkylene, alkenylene, arylene or alkarylene, or a $C_2$–$C_3$ oxyalkylene moiety having from 2 to about 20 oxyalkylene units provided that no O—O or O—N bonds are formed; L is a hydrophilic chain which contains the polyoxyalkylene moiety $-[(R^5O)_m(CH_2CH_2O)_n]-$, wherein $R^5$ is $C_3$–$C_4$ alkylene or hydroxyalkylene and m and n are numbers such that the moiety $-(CH_2CH_2O)_n-$ comprises at least about 50% by weight of said polyoxyalkylene moiety; for said monoamines, m is from 0 to about 4, and n is at least about 12; for said diamines, m is from 0 to about 3, and n is at least about 6 when $R^1$ is $C_2$–$C_3$ alkylene, hydroxyalkylene, or alkenylene, and at least about 3 when $R^1$ is other than $C_2$–$C_3$ alkylene, hydroxyalkylene or alkenylene; for said polyamines and amine polymers, m is from 0 to about 10 and n is at least about 3; p is from 3 to 8; q is 1 or 0; t is 1 or 0, provided that t is 1 when q is 1; w is 1 or 0; x+y+z is at least 2; and y+z is at least 2. The most preferred soil release and anti-redeposition agent is ethoxylated tetraethylenepentamine. Exemplary ethoxylated amines are further described in U.S. Pat. No. 4,597,898, VanderMeer, issued July 1, 1986, incorpoated herein by reference. Another group of preferred clay soil removal/anti-redeposition agents are the cationic compounds disclosed in European patent application No. 111,965, OH and Gosselink, published June 27, 1984, incorporated herein by reference. Other clay soil removal/anti-redeposition agents which can be used include the ethoxylated amine polymers disclosed in European patent application No. 111,984, Gosselink, published June 27, 1984; the zwitterionic polymers disclosed in European Patent Application No. 112,592, Gosselink, published July 4, 1984; and the amine oxides disclosed in U.S. Pat. No. 4,548,744, Connor, issued Oct. 22, 1985, all of which are incorporated herein by reference.

Soil release agents, such as those disclosed in the art to reduce oily staining of polyester fabrics, may also be used in the compositions of the present invention. U.S. Pat. No. 3,962,152, issued June 8, 1976, Nicol et al., incorporated herein by reference, discloses copolymers of ethylene terephthalate and polyethylene oxide terephthalate as soil release agents. U.S. Pat. No. 4,174,305, issued Nov. 13, 1979, Burns et al., incorporated herein by reference, discloses cellulose ether soil release agents.

Enzymes

Enzymes are an optional ingredient generally incorporated in an amount of from about 0.025% to about 2%, preferably from about 0.05% to about 1.5% of the total composition. Preferred proteolytic enzymes should provide a proteolytic activity of at least about 2 Anson units (about 1,000,000 Delft units) per liter, preferably from about 15 to about 70 Anson units per liter, most preferably from about 20 to about 40 Anson units per liter. A proteolytic activity of from about 0.01 to about 0.05 Anson units per gram of product is desirable. Other enzymes, including amylolytic enzymes, are also desirably included in the present compositions.

Suitable proteolytic enzymes include the many species known to be adapted for use in detergent compositions. Commercial enzyme preparations such as Savinase TM and Alcalase TM sold by Novo Industries and Maxatase TM sold by Gist-Brocades, Delft, The Netherlands, are suitable. Other preferred enzyme compositions include those commercially available under the tradenames SP-72 (Esperase TM) manufactured and sold by Novo Industries, A/S, Copenhagen, Denmark and AZ-Protease TM manufactured and sold by Gist-Brocades, Delft, The Netherlands.

Suitable amylases include Rapidase TM sold by Gist-Brocades and Termamyl TM sold by Novo Industries.

Suitable enzymes are further disclosed in U.S. Pat. No. 4,101,457, Place et al., issued July 18, 1978, and in U.S. Pat. No. 4,507,219, Hughes, issued Mar. 26, 1985, both incorporated herein by reference.

Stabilizing System

Preferably, the liquid detergent compositions of the present invention contain a stabilizing agent to maintain the fabric care agent uniformly dispersed in the liquid medium. Otherwise, density differences between the insoluble particles and the liquid base detergent can cause eventual particle settling or creaming.

The choice of the stabilizing agent for the present compositions depends upon factors such as the type and level of solvent ingredients in the composition.

Suitable suspending agents include various clay materials, such as montmorillonite clay, quaternized montmorillonite clays (e.g. Bentone TM 14, available from NL Industries), hectorites (e.g., Laponite TM S., available from La Porte), polysaccharide gums (e.g., xanthan gum available from the Kelco Division of Merck & Co., Inc.), any of several long-chain acyl derivative materials or mixtures of such materials; diethanolamide of a long-chain fatty acid (e.g., PEG 3 lauramide), block polymers of ethylene oxide and propylene oxide (such as Pluronic TM F88 offered by BASF Wyandotte), sodium chloride, ammonium xylene sulfonate, sodium sulfate and polyvinyl alcohol. Other suspending agents found useful are alkanol amides of fatty acids, having from about 16 to about 22 carbon atoms, preferably from about 16 to about 18 carbon atoms. Preferred alkanol amides are stearic monoethanolamide, stearic diethanolamide, stearic monoisopropanolamide and stearic monoethanolamide stearate. Other long-chain acyl derivatives include long-chain esters of long-chain alkanol amides (e.g., stearamide DEA distearate, stearamide MEA stearate).

The most preferred suspending agents for use in the present invention are quaternized montmorillonite clay and hectorite clay.

This suspending agent is preferably present at a level of from about 0.1% to about 10.0%, preferably from about 0.5% to about 3.0%.

Other Optional Detergent Ingredients

Other optional ingredients which can be included in detergent compositions of the present invention, in their conventional art-established levels for use (generally from 0 to about 20%), include solvents, hydrotropes, solubilizing agents, processing aids, soil-suspending agents, corrosion inhibitors, dyes, fillers, optical brighteners, germicides, pH-adjusting agents (monoethanolamine, sodium carbonate, sodium hydroxide, etc.), enzyme-stabilizing agents, bleaches, bleach activators, perfumes, and the like.

Product Formulations

Liquid detergent compositions of the present invention comprise a liquid base as previously discussed. The liquid detergent compositions further comprise the ion-pair conditioning agent particles, preferably between about 0.1% and about 20%, total composition weight basis, and the alkyl sulfate/alkyl ethoxylated sulfate surfactant component in an amount totaling at least 5.0% of the total composition, weight basis and, for practical reasons related to control of excessive sudsing, preferably less than about 40%, more preferably less than about 25%.

The ratios of water and other solvents in the compositions will be determined in part by the resulting state of the fabric care agent. At ambient temperatures, the conditioning particles should be substantially insoluble in the product, and within the particle size specifications heretofore discussed. Also, in preferred executions of the invention, the product desirably is free-flowing across a reasonable temperature range, encompassing the conditions typical for storage and use.

The level of the essential alkyl sulfate/alkyl ethoxylated sulfate surfactant component effective for increasing the stability of the conditioning particles is dependent upon the particular type and/or concentration of: conditioning particles; liquid base (particularly if nonaqueous solvents are used); the alkyl sulfate/alkyl ethoxylated sulfate surfactant component; and, if present, builders and other surfactants. Other ingredients not specifically listed herein can also affect ion-pair conditioning particle stability.

Fatty acid builders and sulfonate surfactants, such as the linear alkyl benzene sulfonate surfactants, in conjunction with fatty acid builders, nonionic surfactants such as alkyl polyethoxylated alcohols and polar solvents such as monohydric alcohols are particularly aggressive toward the conditioning particles in liquid detergent compositions. Accordingly, a higher concentration of the alkyl sulfate/alkyl ethoxylated sulfate surfactant component will generally be required to effect a significant stability benefit for the conditioning particles when these aggressive detergent ingredients are incorporated into the detergent composition, relative to when such aggressive detergent ingredients are not present in the detergent composition. When significant levels of such aggressive ingredients are present in the detergent compositions, typically 7.0% or more of the detergent composition should be the alkyl sulfate-/alkyl ethoxylated sulfate surfactant component.

The pH of the liquid detergent compositions is between about 5 and about 10, preferably between about 5 and about 9. The lower limit is presented for practical reasons related to cleaning performance of the detergent components conventionally used in liquid laundry detergents and the adverse effect of excessively low pH on many textile materials. The pH should be below about 10, however, since higher pH tends to excessively adversely affect the chemical stability of the ion-pair complex component(s) of the conditioning particles. Without being limited to theory and by way of explanation, it is believed that such high pH induces the proton bonded to the amine of the ion-pair complex to deprotonate, thereby disrupting the ionic-bonding necessary for continuity of the complexed ions.

Other optional components of liquid detergent compositions include, but are not limited to, colorants, perfumes, bacterial inhibitors, optical brighteners, opacifiers, viscosity modifiers, fabric absorbency boosters, emulsifiers, stabilizers, shrinkage controllers, spotting agents, germicides, fungicides, anticorrosion agents and the like.

One preferred method for making stable, one-phase liquid detergent compositions is disclosed in U.S. Ser. No. 153,105, Robert Mermelstein and Ronald L. Jacobosen, "Stable Heavy Duty Liquid Detergent Compositions Which Contain a Softener and Antistatic Agent," cofiled with the present case on Feb. 8, 1988., and incorporated by reference herein. In general, said incorporated case discloses a process for making a stable, one-phase liquid detergent composition containing: alkyl sulfate and/or alkyl ethoxylated sulfate anionic surfactant; the conditioning particles of the present invention; cumene, xylene or toluene sulfonate surfactant, or a mixture thereof; a smectite-type clay softener; and a nonionic surfactant produced by condensing ethylene oxide with a straight or branched alkyl chain containing from about 8 to about 16 carbon atoms, the nonionic surfactant having an HLB of from about 8 to about 15. A stable liquid detergent composition is said to be obtained by mixing the clay in the liquid base at a high rate of shear, for example by mixing at about 150,000 $sec^{-1}$ with a homogenizer. Suitable homogenizers are available from APV Gaulin, Inc., Everett, Mass.

Liquid detergent compositions of this invention can also be adapted to a thru-the-wash laundry article which comprises the liquid base, the conditioning particles and alkyl sulfate/alkyl ethoxylated sulfate surfactant component, with or without other detergent, fabric care or other laundry actives contained within a laundry article which releases the liquid detergent composition in water. These laundry articles include dissolvable laundry products, such as dissolvable pouches.

The conditioning agent particles used in the present invention may also comprise nonsilicone waxes in addition to the ion-pair complex(s), as disclosed in U.S. Ser. No. 061,063, filed June 10, 1987, incorporated herein by reference.

Particles comprising an amine-organic anion ion-pair complex, and optionally comprising an amine-inorganic anion ion-pair complex and nonsilicone wax can be formed by mixing the components in molten form and then forming particles by the methods discussed above, said method not being intended to exclude other methods for forming particles comprising the aforesaid components. Exemplary nonsilicone waxes include hydrocarbon waxes, such as paraffin wax, and microcrystalline wax. The weight ratio of ion-pair complex(s) to wax is preferably between about 1:10 and about 10:1.

In a laundry method aspect of the invention, typical laundry wash water solutions comprise from about 0.1% to about 2% by weight of the detergent compositions of the invention. Fabrics to be laundered are agitated in these solutions to effect cleaning, stain removal, and fabric care benefits.

A useful method for determining an effective level of alkyl sulfate/alkyl ethoxylated sulfate surfactant component for stabilizing the conditioning particles in a liquid detergent composition is to measure the antistatic performance of the conditioning particles for a laundry load washed in cold water after the composition has been aged at elevated temperatures, and then comparing this performance to an alkyl sulfate/alkyl ethoxylated sulfate-free control composition of otherwise substantially the same ingredients after such control composition has been similarly aged.

The detergent compositions of the present invention will impart a statistically significant decrease in static relative to the control compositions. Preferably, a sufficient amount of alkyl sulfate/alkyl ethoxylated sulfate surfactant component is incorporated into the composition such that the static of the laundry load is reduced to less than about 40%, preferably less than about 25%, of the static for the control laundry load after the alkyl sulfate/alkyl ethoxylated sulfate surfactant component-containing detergent composition and control detergent composition have aged at 90° F. (about 32.2° C.) for seven days, preferably for 28 days.

Static of the laundry load can be determined by measurement of electric charge of the laundry load upon completion of an automatic laundry dryer stage. The electric charge can be measured with the use of a Faraday cage, a measurement device known in the art. Total electric charge should be determined by summing the differences in electric charge measured upon removal of each of the pieces of fabric from the laundry load, until all of the fabric pieces are removed from the Faraday cage.

The laundry load for the control and test compositions should be dried under substantially equivalent conditions. Conventional automatic dryer temperature ranges, typically between about 110° F. (about 43.3° C.) and about 180° F. (about 82.2° C.) are preferred. Also the automatic dryer is desirably located in an environment having a constant relative humidity, preferably of about 20% to about 25% at about 70° F. (about 21.1° C.).

The quantity of liquid detergent utilized will be dependent upon the size of the load, strength of the detergent, and degree of cleaning performance desired and should be identical for the control and test loads. The laundry load for the control and test detergent compositions should also be identical as to the types of fabrics included. A significant number of fabric articles should include fabric materials which conventionally become statically charged when dried by automatic laundry dryers. Preferably, a mix of fabrics at least including cotton, polyester, acrylic and nylon is used. The detergent dosage per load of laundry should be determined consistent with the acceptable dosages for laundry detergent usage in the laundry detergent art.

The liquid detergent compositions of the invention are particularly suitable for laundry use, but are also suitable for other applications, for example, as conditioning shampoo for hair.

The foregoing description fully describes the nature of the present invention. The following examples are presented for the purpose of illustrating the invention. The scope of the invention is to be determined by the claims, which follow the examples.

All parts, percentages and ratios herein are by weight unless otherwise specified.

EXAMPLES

The following examples illustrate the present invention. The scope of the present invention is to be defined by the claims which follow. The abbreviations used are:

| Code | Ingredient |
|---|---|
| $C_{13}$HLAS | $C_{13}$ linear alkylbenzene sulfonic acid |
| $C_{11.4}$HLAS | $C_{11.4}$ linear alkylbenzene sulfonic acid |
| NI 23–6.5T | $C_{12-13}$ alkyl polyethoxylate (6.5 T) available as Neodol 23-65 T from Shell T = stripped of lower ethoxylated fractions and fatty alcohol |
| stabilizer | Bentone-14 quaternized montmorillonite clay obtained from NL Industries |
| DTPA | sodium diethylenetriaminepentaacetate |
| PPT | poly(terephthlate propyleneglycol ester) ethoxylated with about 30 moles of ethylene oxide |
| TEPA-$E_{15-18}$ | tetraethylene pentaimine ethoxylated with 15–18 moles (avg.) of ethylene oxide at each hydrogen site on each nitrogen |
| DTA | ditallow amine |
| DSA | distearyl amine |
| $C_3$LAS | $C_3$ linear alkyl benzene sulfonate (cumene sulfonate) |
| $SO_4$ | sulfate |
| Misc | can include enzymes, enzyme stabilizers, other phase stabilizers, perfumes, brighteners, dyes, water, other solvents, pH adjusting agents (e.g., monoethanolamine, diethanolamine, triethanolamine, KOH, NaOH, $NH_4OH$ and salts), suds suppressor, dispersant, and anti-redeposition agents. |

EXAMPLE I

This example demonstrates the synthesis and generation of conditioning particles made from a combination of ditallow amine-linear $C_3$ alkylbenzene sulfonate ($C_3$LAS) ion-pair complex and ditallow amine-sulfate ion-pair complex.

The ditallow amine-$C_3$LAS ion-pair complex is formed by combining a 1:1 molar ratio of ditallow amine (available from Sherex Corporation, Dublin, Ohio as Adogen® 240) and cumene sulfonic acid. The acid is slowly added to a 70° C. to 150° C. melt of the amine with agitation to provide a homogeneous fluid. Distearyl amine, also available from Sherex Corporation, complexed with $C_3$LAS can be made by substantially the same method. This complex can then be directly prilled to form particles or can be mixed with ditallow amine sulfate ion-pair complex made as described below.

The ditallow amine-sulfate ion-pair complex is formed by combining a 2:1 molar ratio of ditallow amine and sulfuric acid. The acid is slowly added to a 70° C. to 150° C. melt of the amine with agitation to provide a homogeneous fluid. The ditallow amine-$C_3$LAS complex and the ditallow amine-sulfate complex, respectively, are then mixed together at a weight ratio of 70:30. The ion-pair complex or mixture of ion-pair complexes is kept well mixed by recirculation and hydraulically forced through a heated nozzle to form particles of the complex which have mean diameters of between about 50 and about 200 microns. Alternately, the comelt can be forced through the nozzle by air injection.

This method of synthesis and generation of the ditallow amine-$C_3$LAS particles and the ditallow amine-$C_3$LAS/ditallow amine-sulfate conditioning particles can also be used to make other amine-organic anion conditioning particles, such as distearyl amine-$C_3$LAS particles, and other amine-organic anion/amine-inorganic anion ion-pair conditioning paticles including, but not limited to, the combinations shown below:

| Conditioning Particle Ion-Pair Combination | Amine-Organic Anion | Amine-Inorganic Anion |
|---|---|---|
| 1. | Ditallow amine-$C_3$LAS | Distearyl amine-sulfate |
| 2. | Distearyl amine-$C_3$LAS | Distearyl amine-sulfate |
| 3. | Distearyl amine-$C_3$LAS | Ditallow amine-sulfate |

The amine-organic anion to amine-inorganic anion ion-pair complex proportions can be modified to other ratios within the range of about 95:5 to about 5:95, preferably within the range of about 40:60 to about 90:10.

These particles can be used as disclosed in the following examples by forming the particles as discussed above and then mixing them with the appropriate detergent components. All such compositions can be added to the laundry before or during the wash stage of fabric laundering without significantly impairing cleaning performance, while still providing excellent fabric conditioning.

EXAMPLES II–VII

The following liquid detergent compositions are representative of the present invention and are made as described above in Example I.

| | II | III | IV | V | VI | VII |
|---|---|---|---|---|---|---|
| $C_{13}$HLAS or $C_{11.4}$ HLAS | 8.0 | 8.0 | — | — | — | 17.8 |
| Sodium $C_{12-13}$ alkyl polyethoxylate (1.0) sulfate | — | — | 10.0 | 9.4 | 7.0 | — |
| $C_{14-15}$ alkyl polyethoxylate (2.25) sulfate | 20.0 | 15.0 | — | — | — | 11.0 |
| NI 23-6.5 T | 5.0 | 2.0 | 17.0 | 21.5 | 10.8 | 9.0 |
| $C_{12-14}$ fatty acid | 11.0 | 3.5 | — | — | — | — |
| $C_{8-15}$ alkenyl succinate | — | — | — | — | — | 14.0 |
| Sodium citrate | 4.0 | 5.0 | — | 0.2 | 0.1 | 2.0 |
| Ether polycarboxylate TMS/TDS mixture) | — | 5.0 | — | — | — | — |
| Propanediol | 8.5 | 5.0 | — | — | — | 15.0 |
| Ethanol | 3.5 | — | 7.5 | 7.3 | 3.0 | — |
| PPT | 1.0 | — | — | — | — | 1.0 |
| DTPA | 0.3 | 0.3 | — | 0.2 | 0.2 | 0.3 |
| TEPA $E_{5-18}$ | 2.0 | 1.5 | 1.5 | 1.5 | 1.5 | 1.5 |
| Protease enzyme | 0.7 | 0.7 | 0.6 | 1.1 | 1.1 | 0.6 |
| Amylase enzyme | 0.2 | 0.2 | 0.2 | 0.2 | 0.2 | 0.3 |

-continued

| | II | III | IV | V | VI | VII |
|---|---|---|---|---|---|---|
| Stabilizer | 0.75 | 0.75 | 1.5 | 0.3 | 1.5 | 0.75 |
| Conditioning particles | | | | | | |
| DTA—$C_3$LAS | — | — | — | 3.5 | — | — |
| DTA—$C_3$LAS/ $(DTA)_2$—$SO_4$ | — | 5.0 | — | — | — | — |
| DSA—$C_3$LAS | — | — | 3.5 | — | 4.0 | — |
| DSA—$C_3$LAS/ $(DSA)_2$-$SO_4$ | 5.0 | — | — | — | — | 5.0 |
| Water and miscellaneous | Balance to 100% | | | | | |

The conditioning particles can be made as described in Example I.

These compositions give excellent cleaning as well as excellent static control and softening benefits (without impairing cleaning).

EXAMPLE VIII

A heavy duty liquid laundry detergent composition of the present invention is as follows.

| Component | Weight % |
|---|---|
| Sodium $C_{12-13}$ alkyl polyethoxylate (1.0) sulfate | 8.5 |
| $C_{12-13}$ alcohol polyethoxylate (6.5) | 9.7 |
| Sodium cumene sulfonate | 4.5 |
| Prills | 6.4 |
| Distearyl amine-$C_3$LAS (70%) | |
| Distearyl amine-sulfate (30%) | |
| Smectite clay (Bentone 14, organically modified montmorillonate) | 1.4 |
| Ethanol | 3.4 |
| Sodium formate | 1.4 |
| Calcium formate | 0.1 |
| Sodium diethylenetriamine pentaacetic acid (DTPA) | 0.4 |
| Water and miscellaneous includes anti-redeposition agent and brighteners) | Balance to 100% |

The process used to make this composition is as follows. The percent activities are given as weight percents in aqueous solution.

| Step | | Weight % |
|---|---|---|
| 1. | Water | 20.9 |
| | Brightener | 0.1 |
| | DTPA | 0.2 |
| | Sodium formate (30% activity) | 4.8 |
| | $C_{12-13}$ alcohol polethoxylate (6.5) | 9.7 |
| | Anti-redeposition agent (80% activity) | 1.7 |
| | Calcium formate (10% activity) | 0.9 |
| 2. | Clay slurry in water (5% slurry) | 27.1 |
| 3. | Alkyl ethoxylated sulfate | 18.1 |
| | Sodium $C_{12-14}$ alkyl poly-ethoxylate (1.0) sulfate | 47.0% |
| | Ethanol | 18.6 |
| | Na5 DTPA | 1.1 |
| | Water | 33.3 |
| | Sodium cumene sulfonate (45% activity) | 10.0 |
| 4. | Prills (10–500 microns diameter, 170 microns, average) | 6.4 |
| | Distearl amine-$C_3$LAS (70%) | |
| | Distearyl amine-sulfate (30% | |

The ingredients listed in step 1 are added to a mixing tank with a single agitator in the order which they appear above. Before the calcium formate is added, the pH of the mix is lowered to below 9.0 by adding 0.04 parts of citric acid. The clay slurry listed in step 2 is made by mixing the clay into water with an agitator. This clay slurry (step 2) is immediately added to the ingredients from step 1. This formulation intermediate is then processed through a Gaulin Homogenizer at a pressure of 6000 psig, shear rate of 150,000 $sec^{-1}$, and for 1 pass. This processing step is critical to activate the clay as an effective suspension agent. Product mading continues by adding the ingredients listed in step 3, in the order which they appear above, to the formulation intermediate which was processed through the homogenizer. The ingredients are hand mixed at this point. Finally, the prills described in step 4 are added and mixed in by hand, followed by mechanical agitation for less than a minute.

The stable one-phase heavy duty liquid has a viscosity of about 480 cps at 70° F. (about 21.1° C.), a pH of 9.1, and a yield value of about 146 dynes/$cm^2$.

What is claimed is:

1. A liquid detergent composition comprising:

(a) from 5.0% to about 40% of a surfactant component, said surfactant component containing surfactants selected from the group consisting of alkyl sulfates, alkyl ethoxylated sulfates having an average of less than about 4.0 ethoxylate groups per alkyl sulfate molecule, and mixtures of alkyl sulfates and alkyl ethoxylated sulfates, said mixtures having an average of less than about 4.0 ethoxylate groups per molecule of said surfactants;

(b) from about 0.1% to about 20% of water-insoluble conditioning particles having an average diameter of from about 10 microns to about 500 microns, said particles comprising (i) from about 5% to about 95%, total particle weight basis, of an amine-organic anion ion-pair complex having the formula:

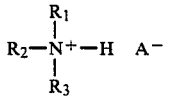

wherein each $R_1$ and $R_2$ independently is $C_{12}$–$C_{20}$ alkyl or alkenyl, each $R_3$ is H or $CH_3$, and A is an organic anion selected from the group consisting of alkyl sulfonates, aryl sulfonates, alkylaryl sulfonates, alkyl sulfates, dialkyl sulfosuccinates, alkyl oxybenzene sulfonates, acyl isethionates, acylalkyl taurates, alkyl ethoxylated sulfates, and olefin sulfonates, and mixtures of said ion-pair complexes; and (ii) from about 95% to about 5%, total particle weight basis, of an amine-inorganic anion ion pair complex or mixture of complexes having the formula:

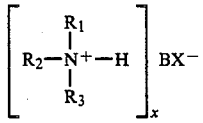

wherein each $R_1$ and $R_2$ independently is $C_{12}$–$C_{20}$ alkyl or alkenyl, each $R_3$ is H or $CH_3$, and B is an inorganic anion selected from the group consisting or nitrate, sulfate, hydrogen sulfate, phosphate, hydrogen phosphate, and dihydrogen phosphate, and x is an integer between 1 and 3, inclusive; and (c) a liquid base;

said detergent composition having a pH of between about 5 and about 10.

2. A liquid detergent composition, as in claim 1, wherein said surfactant component has an average number of ethoxylate groups per surfactant molecule of from 0 to about 3.0.

3. A liquid detergent composition, as in claim 2, wherein said surfactants have $C_{12}$–$C_{16}$ alkyl or hydroxyalkyl group.

4. A liquid detergent composition, as in claim 3, wherein said organic anion is benzene sulfonate or a $C_1$–$C_{13}$ linear alkyl benzene sulfonate.

5. A liquid detergent composition, as in claim 1, wherein said organic anion is benzene sulfonate or a $C_1$–$C_{20}$ linear alkyl benzene sulfonate.

6. A liquid detergent composition, as in claim 1, wherein said composition further comprises a detergent builder component.

7. A liquid detergent composition, as in claim 6, wherein said detergent builder component comprises one or more builders selected from the group consisting of $C_{10}$ to $C_{18}$ alkyl or alkenyl monocarboxylic acids, polycarboxylic acids, polymeric carboxylates, and alkenyl succinates.

8. A liquid detergent composition, as in claim 7, wherein said composition comprises from about 7.0% to about 25% of said surfactant component.

9. A liquid detergent composition, as in claim 7, wherein said liquid base comprises water and at least one polar solvent selected from the group consisting of monohydric alcohols and polyols.

10. A liquid detergent composition, as in claim 9, wherein said composition comprises from about 7.0% to about 25% of said surfactant component.

11. A liquid detergent composition as in claim 9, further comprising one or more additional surfactants selected from the group consisting of anionic surfactants, exclusive of alkyl sulfates and alkyl ethoxylated sulfates, and nonionic surfactants.

12. A liquid detergent composition, as in claim 11, wherein said composition comprises from about 7.0% to about 25% of said surfactant component.

13. A liquid detergent composition, as in claim 1, wherein said liquid base comprises water and at least one polar solvent selected from the group consisting of monohydric alcohols and polyols.

14. A liquid detergent composition, as in claim 13, wherein said composition comprises from about 7.0% to about 25% of said surfactant component.

15. A liquid detergent composition as in claim 1, further comprising one or more additional surfactants selected from the group consisting of anionic surfactants, exclusive of alkyl sulfates and alkyl ethoxylated sulfates, and nonionic surfactants.

16. A liquid detergent composition, as in claim 15, wherein said composition comprises from about 7.0% to about 25% of said surfactant component.

17. A liquid detergent composition, as in claim 1, wherein said composition comprises from about 7.0% to about 25% of said surfactant component.

* * * * *

UNITED STATES PATENT AND TRADEMARK OFFICE

CERTIFICATE OF CORRECTION

PATENT NO. : 4,857,213

DATED : August 15, 1989

INVENTOR(S) : Debra Sue Caswell

It is certified that error appears in the above-identified patent and that said Letters Patent is hereby corrected as shown below:

Column 10, line 50, "of" should be --to--.

Column 13, line 4, "Triton #" should be --Triton™--.

Column 16, line 30, "tha" should be --than--.

Column 16, line 61, "rom" should be --from--.

Column 23, line 24, "2" should be --5--.

Column 27, line 31, "23-65T" should be --23-6.5T--.

Column 28, line 67, "$E_{5-18}$" should be --$E_{15-18}$--.

Column 29, line 34, "includes" should be --(includes--.

Column 29, line 57, "Distearl" should be --Distearyl--.

Signed and Sealed this

Third Day of March, 1992

*Attest:*

*Attesting Officer*

HARRY F. MANBECK, JR.

*Commissioner of Patents and Trademarks*